US005305480A

United States Patent [19]

Loren et al.

[11] Patent Number: 5,305,480

[45] Date of Patent: Apr. 26, 1994

[54] BED SPREAD SAVER

[76] Inventors: Robert Loren, 85020 Hwy 101; Karen Morgan-Loren, 85020 Hwy 101 S., both of, Florence, Oreg. 97439

[21] Appl. No.: 40,374

[22] Filed: Mar. 30, 1993

[51] Int. Cl.[5] ..... A47C 21/02

[52] U.S. Cl. ..... 5/504.1

[58] Field of Search ..... 5/504.1, 505.1, 506.1, 5/503.1, 426; 211/175

[56] References Cited

U.S. PATENT DOCUMENTS

| | | | |
|---|---|---|---|
| 2,526,333 | 7/1951 | Ries | 5/504.1 |
| 3,421,159 | 3/1966 | Reed | 5/504.1 |
| 3,435,469 | 4/1969 | Fricke | 5/504.1 |
| 3,961,385 | 6/1976 | Ferry | 5/504.1 |
| 5,001,795 | 3/1991 | Kasten | 5/504.1 |
| 5,038,434 | 8/1991 | Navarrette | 5/426 |

FOREIGN PATENT DOCUMENTS

| | | | |
|---|---|---|---|
| 27135 | of 1911 | United Kingdom | 5/504.1 |

*Primary Examiner*—Alexander Grosz

*Attorney, Agent, or Firm*—John P. Halvonik

[57] ABSTRACT

The invention is a pull-out bed attachment apparatus for supporting a bed spread or similar articles. e.g. luggage at night. The attachment comprises a flat, stationary base board abutting the end of the bed, usually a mattress and box spring. The base board is in connection with at least two support boards that lie perpendicular to the base board and support the base board from between the mattresses. Movable dowel rods slide through apertures in the base board and are connected to a third board-the extension board. The dowel rods slide under the mattress and the extension board is pushed flush against the base board when not in use-typically during the day. When in use, the extension board and dowel rods provide an extended platform for supporting the bed spread.

1 Claim, 2 Drawing Sheets

BED SPREAD SAVER

BACKGROUND OF THE INVENTION

1. Field of the Invention

The invention relates to the field of beds and mattress and attachments thereto. In particular, the invention relates to a pull-out extension apparatus that is held between the mattresses when not in use. The apparatus pulls out at night in order to support quilts, comforters and other coverings that may not be needed. Oftentimes, quilts and other coverings are not needed at night as it is too hot for them. However, the quilts remain on the bed during the day as that is a convenient place to store them. Instead of having to place the quilt on the floor at night, the spread saver provides a supporting surface in close connection with the bed.

2. Description of the Prior Art

No prior art that applicant is aware of is used to support bed spreads by extending out from near the foot of the bed. Nor is he aware of any prior art device that retracts underneath the mattress for storage during the day.

SUMMARY OF THE INVENTION

A pull-out attachment apparatus for connection underneath a mattress. The apparatus may be pulled out at night in order to support a bed spread or similar articles e.g. luggage, etc. The apparatus comprises a flat, stationary base board abutting the end of the mattress and box spring. The base board is in connection with at least two support boards perpendicular to the base board. The support boards support the base board as they lie between the mattress and box spring. Movable dowel rods slide through apertures in the base board and are connected to a third board-the extension board. The dowel rods slide under the mattress and the extension board is pushed flush against the base board when the apparatus is not in use-typically during the day. When in use, the extension board and dowel rods are pulled away from the base board in order to provide an extended platform for supporting the bed spread.

It is an object of the invention to support a bed spread when the bed spread is turned down at night by providing an extended portion extending away from the foot of the bed.

Another object of the invention is to provide a means for supporting a bed spread that is supported in the horizontal direction from underneath a mattress and not in the vertical direction in order to eliminate the need for legs, etc. that may result in injury to the shins if they are bumped into.

Yet another objective is to provide a bed spread support that may be retracted under a mattress when not in use in order to save on space.

Other objectives of the invention will become apparent to those skilled in the art once the the invention has been shown and described.

DESCRIPTION OF THE PREFERRED EMBODIMENT

Figure 1:
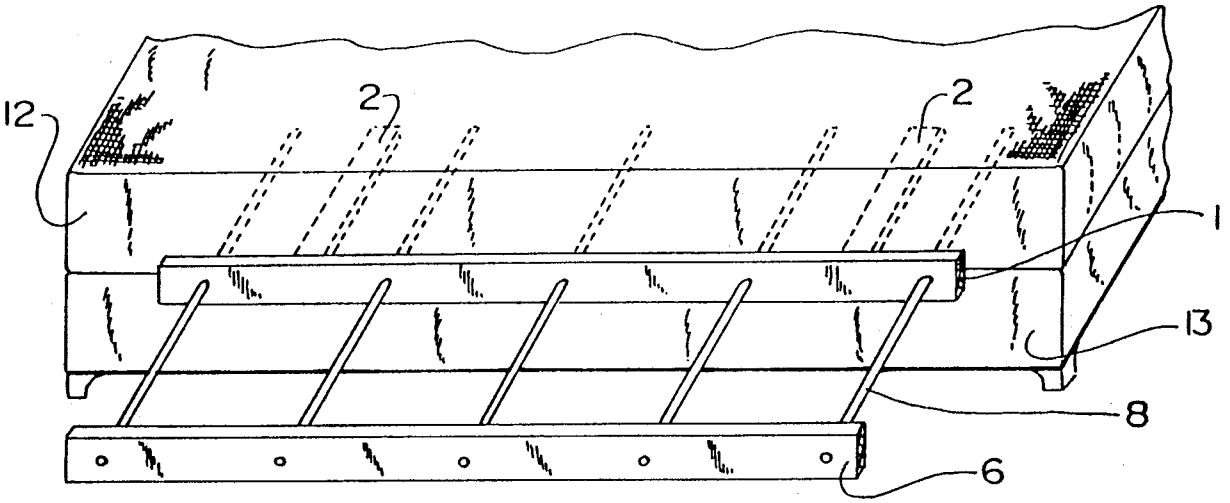
FIG. 1 Shows spread saver in use.

The overall construction of the apparatus is as shown in FIG. 1. There is a base board 1 which lies parallel to the bottom edge of the mattress 12 and is usually flush against it. The base board is supported by support boards 2 which are rigidly connected to the base board and extend between mattress 12 and box spring 13. There are usually at least two support boards and they are perpendicular to the base board, or nearly so.

The support boards are generally flat and should be of long enough length to support the rest of the apparatus when the support boards are placed underneath the mattress. This is as shown in FIG. 1 Generally, beds have a mattress 12 atop a box spring 13 and the support boards may be placed in between the two.

An extension board 6 lies parallel to the base board and is in connection with that board through the dowel rods 8. The rods are permanently attached to the extension board and slide through apertures 10 in the base board. There should be at least 2 dowel rods and corresponding apertures.

Figure 2:
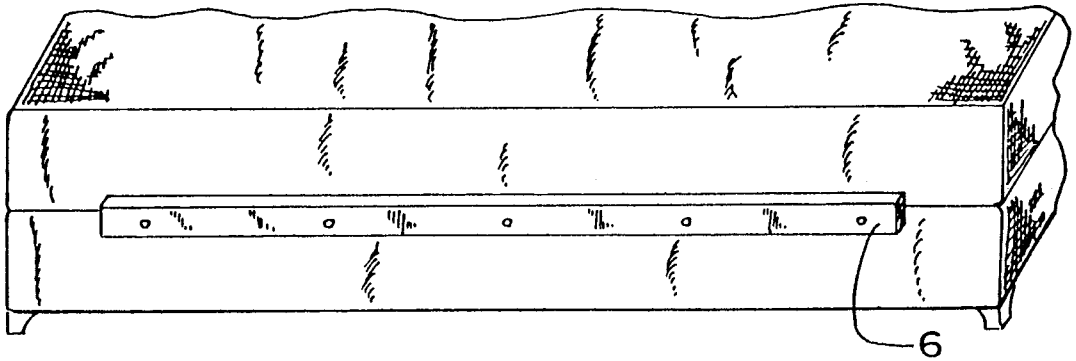
FIG. 2 Shows spread saver retracted when not in use.

The extension board and the dowel rods slide out away from the base board when one wants to use the spread saver. In use the spread saver is used to support quilts and comforters and bed coverings above the floor. During the day, the saver will probably not be in use as these coverings may be stored on the bed. When not in use, the extension board is pushed flat against the base board, see FIG. 2. The dowel rods slide through the apertures and rest underneath the mattress.

Figure 4:
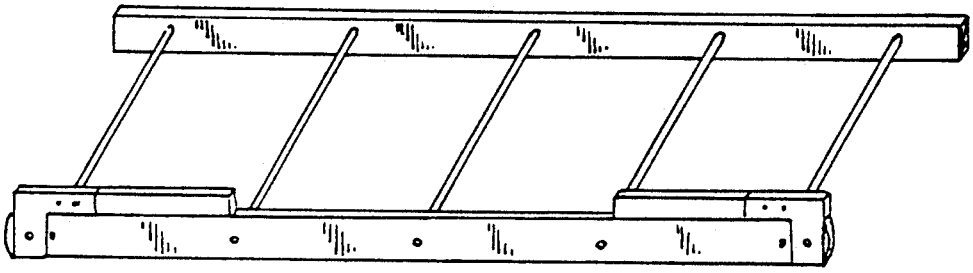
FIG. 4 Shows legs when not in use.
Figure 3:
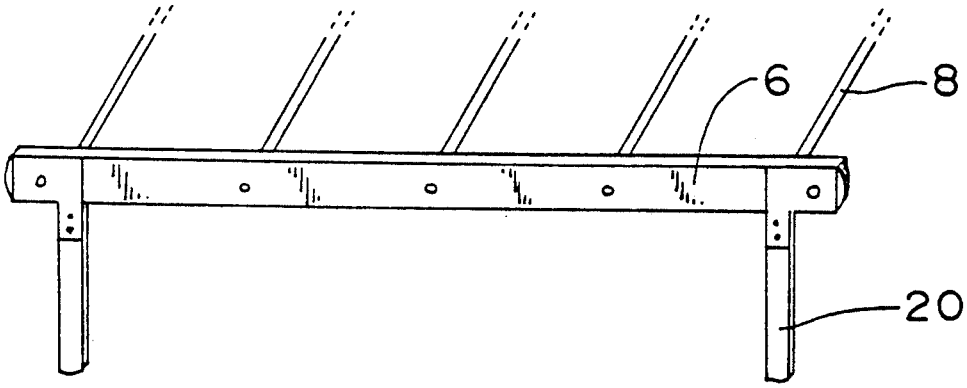
FIG. 3 Shows optional pivoting legs.

The optional version with extended legs is shown in FIG. 3 Legs 20 are in pivotal connection with the extension board. The legs may be pivoted downward in order to add further support for the spread saver. This could be used in cases where the saver is being used to support luggage, etc. The saver could find use in motels, etc. where travellers are on the road. When not in use, the legs are pivoted upward, see FIG. 4.

The support legs are an option, generally the spread saver is designed to support the bed spread entirely by the support boards underneath the mattress 12.

We claim:

1. A bed spread support apparatus for attachment between the mattress and box spring of beds comprising: a base board and at least two support boards in fixed connection to said base board and about perpendicular to said base board so that said support boards may be positioned between said mattress and said box spring, said support boards of length sufficient to support said apparatus from between said mattress and said box spring, said base board having at least two apertures, at least two dowel rods in slidable connection with said apertures for sliding underneath said mattress when said apparatus is not in use, said dowel rods in fixed connection to an extension board, said extension boards about perpendicular to said dowel rods so that said extension board and dowel rods may be extended from said base board in order to support articles, two legs in pivotal connection with said extension board.

* * * * *